US010478658B2

(12) United States Patent
Polenz

(10) Patent No.: US 10,478,658 B2
(45) Date of Patent: Nov. 19, 2019

(54) SPORTS DUMBBELL

(71) Applicant: Christian Polenz, Hamburg (DE)

(72) Inventor: Christian Polenz, Hamburg (DE)

( * ) Notice: Subject to any disclaimer, the term of this patent is extended or adjusted under 35 U.S.C. 154(b) by 0 days.

(21) Appl. No.: 15/500,592

(22) PCT Filed: Jul. 28, 2015

(86) PCT No.: PCT/EP2015/067228
§ 371 (c)(1),
(2) Date: Jan. 31, 2017

(87) PCT Pub. No.: WO2016/016220
PCT Pub. Date: Feb. 4, 2016

(65) Prior Publication Data

US 2017/0209732 A1 Jul. 27, 2017

(30) Foreign Application Priority Data

Jul. 31, 2014 (DE) ..... 10 2014 110 846

(51) Int. Cl.
*A63B 21/072* (2006.01)
*A63B 21/055* (2006.01)
(Continued)

(52) U.S. Cl.
CPC ..... *A63B 21/0726* (2013.01); *A63B 21/0552* (2013.01); *A63B 21/0607* (2013.01);
(Continued)

(58) Field of Classification Search
CPC ..... A63B 21/4035; A63B 21/0004; A63B 21/00043; A63B 21/02; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/0607; A63B 21/065; A63B 21/068;
(Continued)

(56) References Cited

U.S. PATENT DOCUMENTS 734,062 A * 7/1903 Harris ..... A63B 21/0726 482/108
1,511,312 A * 10/1924 Alastalo ..... A63B 21/072 482/105
(Continued)

FOREIGN PATENT DOCUMENTS

DE 72 25 690 10/1972
DE 102 37 083 9/2003
(Continued)

*Primary Examiner* — Gary D Urbiel Goldner
(74) *Attorney, Agent, or Firm* — Bay State IP, LLC

(57) ABSTRACT

A sports dumbbell comprises a grip section (2), which runs along a grip shaft (L1), and a support shaft (L2) of a support section (3) spaced apart from the grip section (2) perpendicular to and running parallel to the grip shaft (L1). The support section is connected at at least one end to the grip section (2). The sports dumbbell has a center of gravity (S) which is arranged within the support section (3). A distance (d2) between the grip shaft (L1) and the support shaft (L2) is at least 11 cm, and an external shape of the sports dumbbell forms a closed annular body or open annular body.

6 Claims, 6 Drawing Sheets

Figure 1:
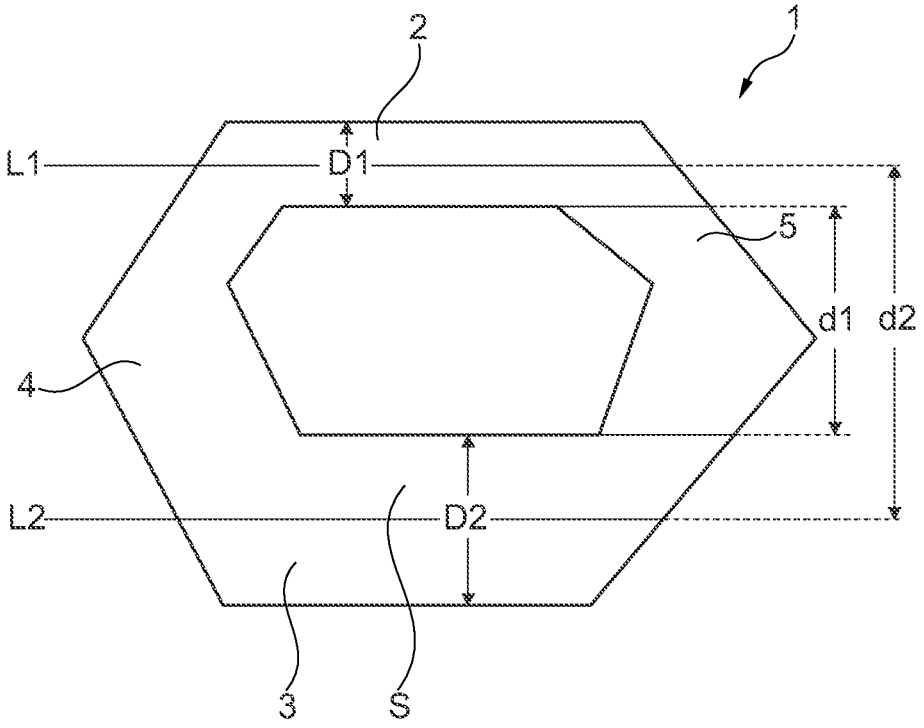

(51) Int. Cl.
*A63B 21/06* (2006.01)
*A63B 21/00* (2006.01)

(52) U.S. Cl.
CPC ..... *A63B 21/4013* (2015.10); *A63B 21/4034* (2015.10); *A63B 21/4035* (2015.10)

(58) Field of Classification Search
CPC ..... A63B 21/072; A63B 21/0722; A63B 21/0724; A63B 21/0726; A63B 21/4011; A63B 21/4013; A63B 21/4015; A63B 21/4023; A63B 21/4025; A63B 21/4033; A63B 21/4034; A63B 21/4041; A63B 21/4043; A63B 2244/09
See application file for complete search history.

(56) References Cited

U.S. PATENT DOCUMENTS 1,637,754 A * 8/1927 McLeod ..... A63B 67/14 473/587
3,482,834 A * 12/1969 James, Jr. ..... A63B 21/0604 482/108
3,734,493 A * 5/1973 Hasekian ..... A63B 21/072 482/108
4,345,756 A * 8/1982 Hoagland ..... A63B 21/075 482/109
D268,437 S * 3/1983 Giordano ..... D21/682
D273,030 S * 3/1984 Anderson ..... D21/682
4,575,074 A * 3/1986 Damratoski ..... A63B 21/0602 482/93
5,135,455 A * 8/1992 King ..... A63B 21/0726 482/105
5,180,352 A * 1/1993 Sreter ..... A63B 21/072 482/1
D340,759 S * 10/1993 Miller ..... D21/680
D343,433 S * 1/1994 Crosson ..... D21/682
5,281,192 A * 1/1994 Nelson ..... A63B 15/00 482/105
5,332,119 A * 7/1994 Davis ..... F41H 9/10 222/175
5,761,767 A 6/1998 Barton
7,316,636 B1 * 1/2008 Hinds ..... A63B 21/0552 482/126
7,473,213 B1 * 1/2009 Kallenbach ..... A63B 21/055 16/428
7,824,312 B1 11/2010 Hsu
8,241,189 B2 * 8/2012 Kanaoka ..... A63B 21/0726 482/108
8,684,889 B1 4/2014 Berrisford
8,882,643 B1 * 11/2014 Calkins ..... A47C 17/86 482/108
D733,815 S * 7/2015 Gustafson ..... D21/694
2006/0189456 A1 * 8/2006 Ford ..... A63B 21/06 482/93
2007/0142755 A1 * 6/2007 Kleiman ..... A61H 15/0092 601/120
2008/0287273 A1 * 11/2008 Ma ..... A63B 1/0552 482/108
2009/0075792 A1 * 3/2009 Stugart ..... A63B 21/06 482/93
2009/0280967 A1 11/2009 Salzwimmer
2010/0298100 A1 * 11/2010 McVan ..... A63B 21/0004 482/45
2014/0024506 A1 1/2014 Vixathep
2014/0179495 A1 6/2014 Payan
2015/0024908 A1 * 1/2015 Hall ..... A63B 21/0726 482/93
2015/0306446 A1 * 10/2015 Spainhower ..... A63B 21/0726 482/106

FOREIGN PATENT DOCUMENTS

JP S52 138874 10/1977
JP S60 92555 6/1985
JP H11 216199 8/1999

* cited by examiner

SPORTS DUMBBELL

CROSS REFERENCE TO RELATED APPLICATION

This application is for entry into the U.S. National Phase under § 371 for International Application No. PCT/EP2015/067228 having an international filing date of Jul. 28, 2015, and from which priority is claimed under all applicable sections of Title 35 of the United States Code including, but not limited to, Sections 120, 363, and 365(c), and which in turn claims priority under 35 USC 119 to German Patent Application No. 10 2014 110 846.9 filed on Jul. 31, 2014.

The invention concerns a sports dumbbell.

DE 8135835 U1 discloses a short dumbbell. The short dumbbell consists of two hollow dumbbell bodies which are firmly bolted to a centre piece.

DE 76154073 U describes a dumbbell which is made from a plastic hollow body with an opening, which is closable by a threaded screw, for the introduction of water.

When used, dumbbells place a load on the wrist joints, which is disadvantageous and in the long term can lead to strain injury.

DE 247381 discloses a dumbbell with a lift weight arrangement, the centre of gravity of which is offset to the handle rod. The arrangement is very complex in construction.

DE 20 2012 003 777 U1 describes a fist dumbbell, the weight of which is surrounded by the hand.

German utility model DE 40 2011 001 849 discloses an asymmetric dumbbell.

The disadvantage of the above-mentioned dumbbell is the asymmetric distribution of weight along the grip axis.

US 2014/0024506 A1 discloses a sports dumbbell with two lateral weights connected together by a connecting rod, from which a handle protrudes. The disadvantage of the dumbbell is the unstable position on the athlete's wrist.

The object of the invention is to provide a dumbbell of the type cited initially which allows exercises that are particularly gentle on the wrist.

This object is achieved by a dumbbell of the type cited initially with the features of claim 1.

The sports dumbbell according to the invention has a grip portion running along a grip axis, and a support axis of a support portion which is spaced from the grip portion perpendicularly to the grip axis and runs parallel to the grip axis, which support portion is relatively immovably connected by least one end to the grip portion. The sports dumbbell has a centre of gravity which is arranged inside the support portion, and a distance between the grip axis and the support axis is at least 11 cm. The sports dumbbell forms a closed annular or open annular body in its outer form. The term "closed annular" here generally means a closed outer form which has a passage opening and the body surrounding this. It need not necessarily be configured in a strictly circular form. The term "open annular" means the outer form of the body as described above in which a segment is missing from the peripheral ring. The body is then substantially U-shaped, or U-shaped with the ends of the U pointing towards each other.

Thanks to the combination according to the invention of the distance between the support axis and the grip axis, and the arrangement of the centre of gravity inside the support portion, preferably in the extension of the support portion centrally in the direction of the support axis, the dumbbell can be gripped by the athlete at the grip axis and placed with the support portion on the hand-side end of the lower arm, wherein to overcome the inertia of the dumbbell when performing sports exercises, a force generated by the lower arm is exerted against the centre of gravity of the dumbbell, whereby no torque is provoked in the wrist or arm. Such a dumbbell is suitable for the performance of particularly strain-free sports exercises.

The term "sports dumbbell" here means a short dumbbell which the athlete can grip in one hand, and which is intended to be so gripped. The extension of the dumbbell along the grip axis is preferably at most 30 cm, preferably between 20 cm and 30 cm. Preferably, the distance between the grip axis and the support axis is between 11 cm and 13 cm. The grip portion is preferably constant over its entire extension along the grip axis, is formed circular in cross-section perpendicularly to the grip axis, and has a diameter of around 3 cm. In cross-section perpendicularly to the support axis, the support portion is formed preferably uniformly along the support axis and is circular with a diameter of between 4 cm and 5.5 cm. The distance between the opposing inner walls of the grip portion and the support portion is around 6 cm.

This support portion is preferably formed heavier than the grip portion in order to achieve the shift of the centre of gravity in the claimed manner.

Preferably, the dumbbell forms a closed annular body in its outer form. For this, favourably along the grip axis, the grip portion has a first and a second mutually opposing end, and along the support axis, the support portion has a mutually opposing first and a second end. The first end of the grip portion is connected to the first end of the support portion, and the second end of the grip portion is connected to the second end of the support portion, via a first and second connecting portion respectively. The term "annular outer form" here means a closed outer form which has an approximately annular shape, i.e. a closed shape, with preferably a single passage hole for the athlete's hand.

In an alternative embodiment, the dumbbell forms a U-shaped or substantially U-shaped body. Along the grip axis, the grip portion has a mutually opposing first and second end, and along the support axis, the support portion has a mutually opposing first and second end. The first end of the grip portion is connected to the first end of the support portion by means of a first connecting portion, but the second end of the grip portion has no direct connection to the second end of the support portion.

Preferably, a maximum diameter of the support portion is between 8.5 cm and 12 cm, and a minimum diameter of the grip portion is 3 cm.

In another embodiment of the sports dumbbell according to the invention, the maximum diameter of the support portion is at most three times as great as the minimum diameter of the grip portion.

Both embodiments firstly allow the dumbbell to be gripped comfortably in one hand but nonetheless, due to the larger support portion, achieve a weight distribution in the direction of the athlete's lower arm.

In a particularly preferred embodiment of the sports dumbbell according to the invention, an end of a strap is provided at both the first and second ends of the grip portion. The strap may be an elastic and preferably also a length-adjustable strap.

Preferably, the entire sports dumbbell in its outer form is completely covered with a plastic coating. The sports dumbbell may be configured as a single or as a multipiece injection moulding. However, preferably, it has no screw joints or other protruding means which could lead to injuries.

It is also conceivable that the sports dumbbell is made of a casting, in particular an injection moulding, or is assembled from two injection mouldings in a smooth outer contour, in particular glued together.

Preferably, the sports dumbbell has a thumb notch in the form of a depression, which gives the athlete's hand additional grip.

Figure 2:
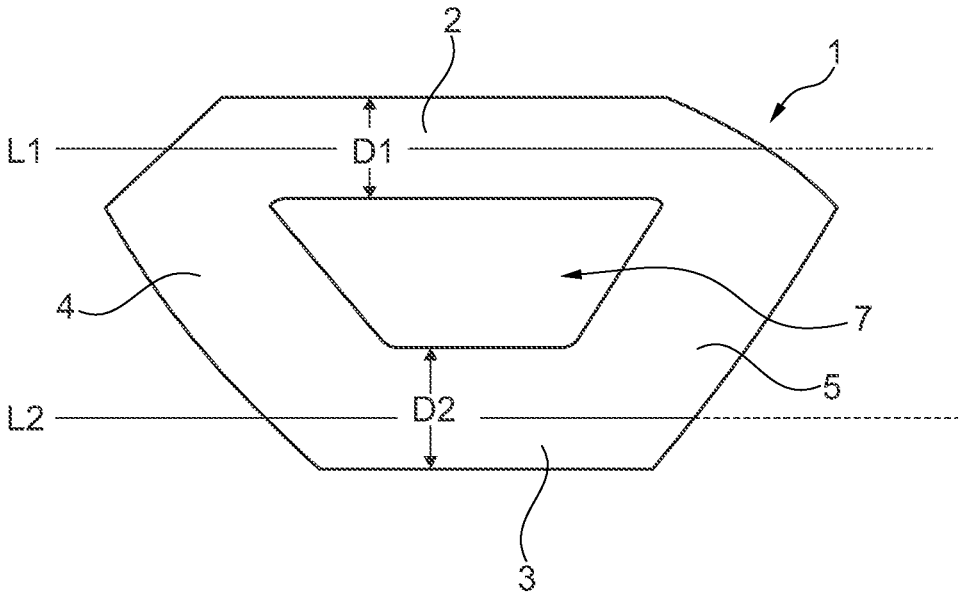
Figure 3A:
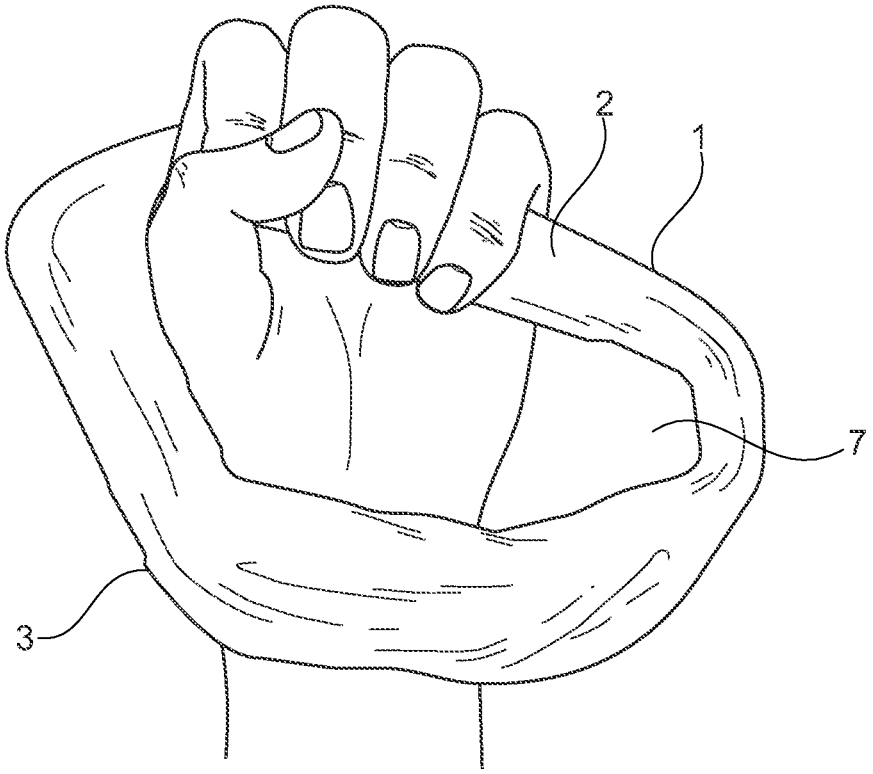
Figure 3B:
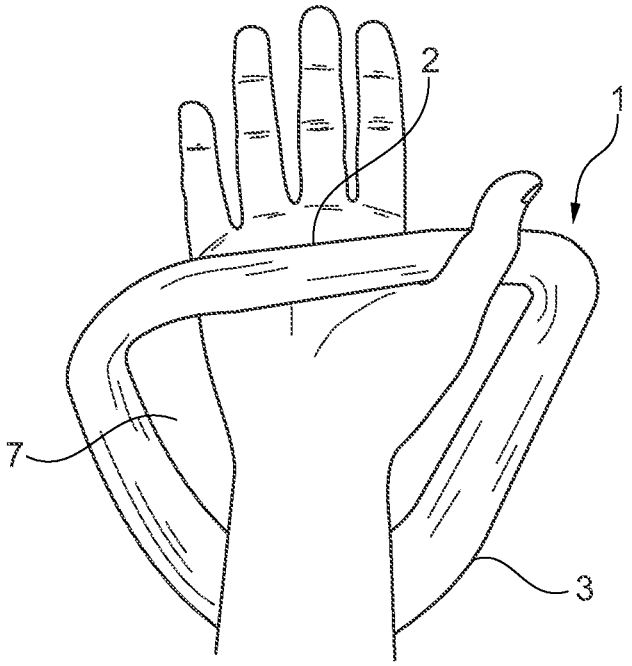
Figure 3C:
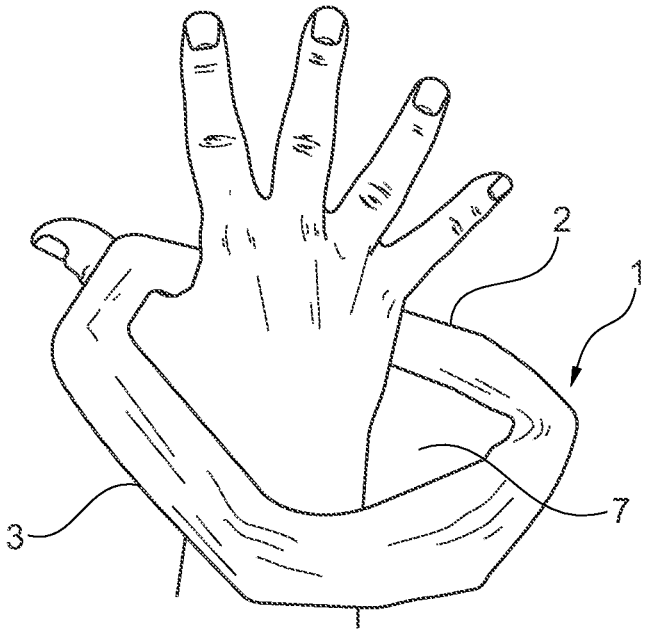
Figure 4:
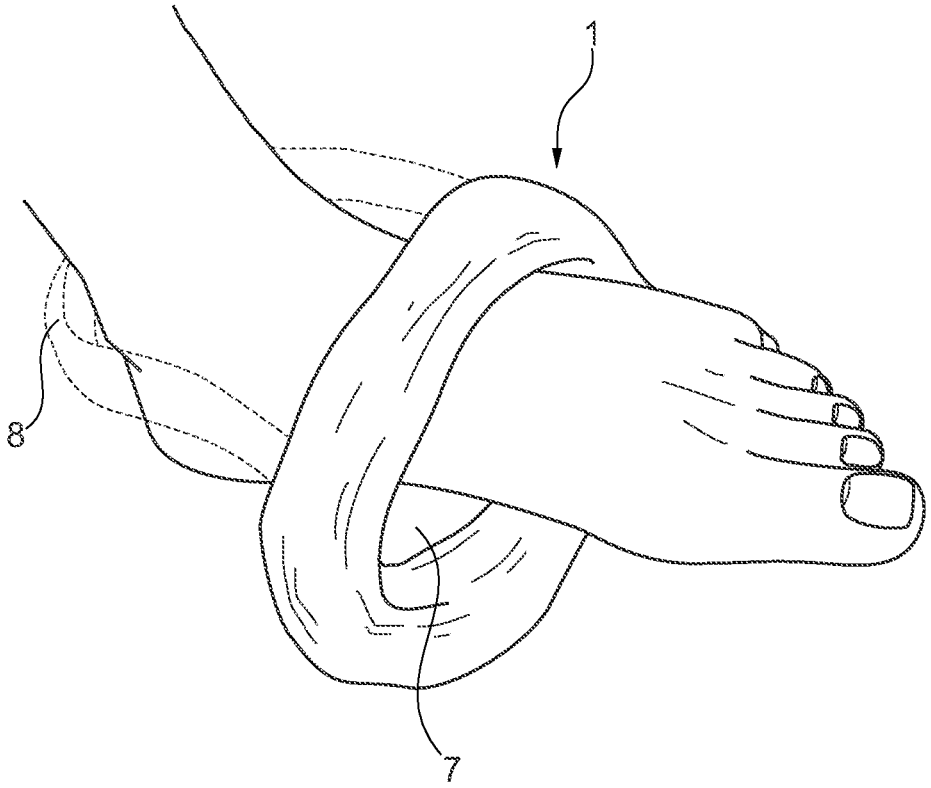
Figure 5:
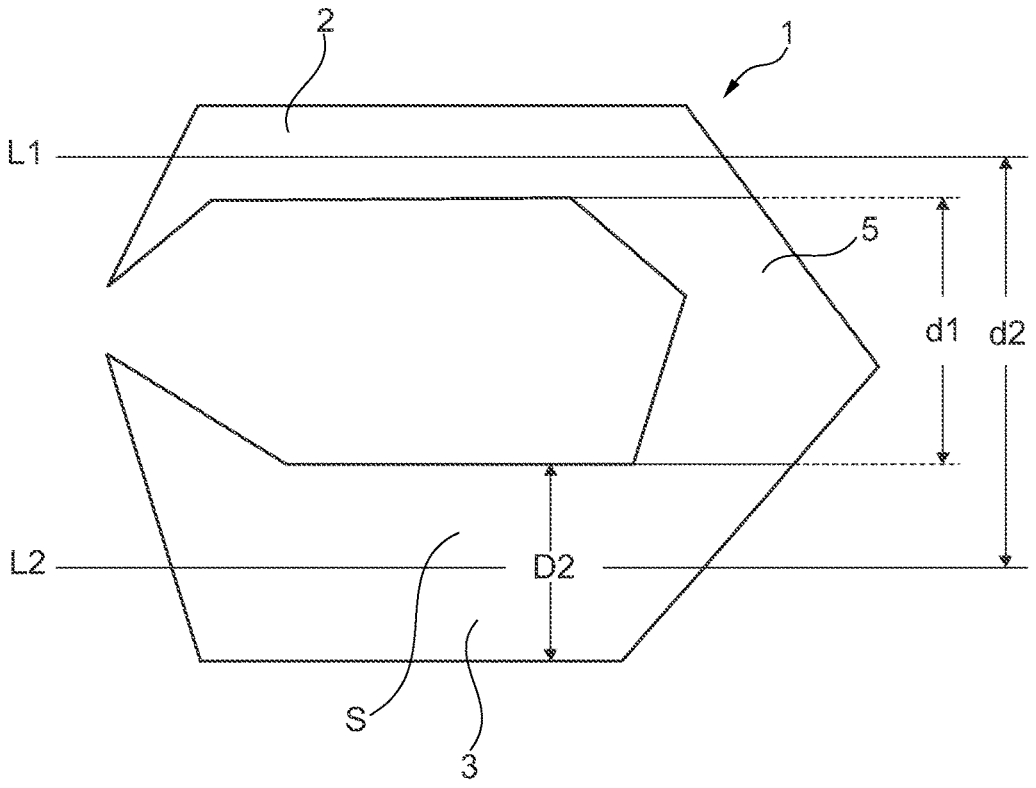

The invention is described with reference to an exemplary embodiment shown in seven figures. The drawings show:

FIG. 1 a side principle view of a sports dumbbell according to the invention in a first embodiment, FIG. 2 a perspective view of the sports dumbbell in FIG. 1, FIG. 3*a*-FIG. 3*c* positions of the dumbbell in FIG. 1 in an athlete's hand, FIG. 4 the sports dumbbell in FIG. 1 with a strap for holding on the foot, FIG. 5 a sports dumbbell according to the invention in a second embodiment.

FIGS. 1-4 shows a sports dumbbell in a first embodiment.

The sports dumbbell 1 shown in FIG. 1 has a grip portion 2 and a support portion 3. The grip portion 2 has a grip axis L1 arranged centrally along a longitudinal extension. The grip portion 2 is intended to be gripped by an athlete's hand. A support portion 3 is arranged opposite the grip portion 2, perpendicularly to the grip axis L1. The support portion 3 has a support axis L2 arranged parallel to the grip axis L1. The grip axis L1 and the support axis L2 each pass centrally through the respective portions 2, 3.

Along its grip axis L1, the grip portion 2 has a mutually opposing first end and a second end, and along the support axis L2, the support portion 2 has a mutually opposing first end and a second end. The respective first ends are connected together rigidly with fixed position via a first bow-shaped connecting portion 4. The two second ends are also connected together rigidly with fixed position via a second connecting portion 5, which is configured substantially mirror-symmetrically to the first connecting portion 4. A distance d1 between inner walls of the grip portion 2 and the support portion 3 here amounts to 6 cm. Other dimensions are however conceivable. A distance d2 between the grip axis L1 and the support axis L2 is between 11 cm and 13 cm. The distance d2 is dimensioned such that when the grip portion 2 is gripped by the athlete's hand, the support portion 3 rests on his lower arm on the elbow side of the wrist. By resting the weight on the lower arm, the wrist is under significantly less load than from conventional dumbbells when sports exercises are performed.

A diameter D1 of the grip portion 2 is at least 3 cm. It is here constant along its entire extension along the grip axis L1. A diameter D2 of the support portion 3 is between 8.5 cm and 11 cm. In the embodiment in FIG. 1, it is also constant along its entire extension along the support axis L2.

The weight distribution is dimensioned such that a centre of gravity S of the sports dumbbell 1 is arranged on the grip portion 2 centrally in the direction of the grip axis L1, but the centre of gravity S is arranged not inside the grip portion 2 perpendicularly to the grip axis L1, but inside the support portion 3, so that during sports exercises the weight of the sports dumbbell is not moved via the wrist but via the hand-side ends of the lower arms. The sports dumbbell 1 is configured substantially mirror-symmetrically along a mirror plane arranged perpendicularly to the grip axis L1 and the support axis L2, in order to allow an approximately central positioning in the axial direction.

FIG. 2 shows the sports dumbbell 1 in FIG. 1 in a perspective view. The grip portion 3 extended in the longitudinal axis L1 has connecting portions 4, 5 at its first and second ends, which are connected respectively to the first and second ends of the grip portion 2. The grip portion 2, the connecting portions 4, 5 and the support portion 3 form a closed annular outer form, where the term "annular" here does not mean a strictly circular outer form but a closed form with a passage hole 7. The passage hole 7 is intended for an athlete's hand to pass through.

A cross-section of the connecting portions 4, 5 is constant, and that of the support portion 3 is also substantially constant perpendicularly to the peripheral direction; a cross-section of the handle portion 2 along and perpendicularly to the peripheral direction, at 3 cm in diameter D1, is significantly smaller than the diameter D2 of the support portion 3. The diameter D2 of the support portion 3 is between 8.5 cm and 11 cm. The outer dimensions of the sports dumbbell in FIG. 2 are 28 cm to 30 cm in the direction of the grip axis L1 or the support axis L2, and 17.5 cm to 20 cm perpendicularly to the grip axis.

FIGS. 3*a* to 3*c* show the grip hold of a athlete for performing sports exercises. FIG. 3*b* shows the sports dumbbell 1 of FIG. 1 held by an athlete at the grip portion 2. The support portion 3 lies on the back-hand side of the lower arm, wherein the contact point of the grip portion 2 lies on the arm side of the wrist. The centre of gravity S of the entire sports dumbbell 1 also lies inside the support portion 3, so that on when the arms are moved, the contact point of the force is provided on the arm side of the wrist, and hence there is no excessive strain on the wrist.

FIGS. 3*b* and 3*c* show a grip hold of the sports dumbbell 1 with the hand open; once from the front of the hand and once from the back of the hand.

FIG. 4 shows a second embodiment of the sports dumbbell 1 according to the invention, wherein eyelets (not shown) are provided on the connecting portions 4, 5, at the ends of which an elastic and/or length-adjustable strap 8 is arranged, which can therefore be held behind the heel of the athlete if the athlete extends his foot through the passage opening 7 of the sports dumbbell. Then strengthening and sports exercises using the legs can also be performed.

FIG. 5 shows a second embodiment of the sports dumbbell 1 according to the invention. The same reference numerals designate the same features. The sports dumbbell 1 has a grip portion 2 and a support portion 3, which may be formed as in the first embodiment. In contrast to the first embodiment, only the second connecting portion 5 is provided between the grip portion 2 and the support portion 3, which holds the grip portion 2 and the support portion 3 fixed in position relative to each other. There is no first connecting portion 4. The sports dumbbell 1 is open at the first end. The sports dumbbell 1 is therefore not annular in a cross-section in the plane formed by the grip axis L1 and the support axis L2, as in the first embodiment, but is configured substantially U-shaped. The centre of gravity S is arranged inside the support portion 3.

LIST OF REFERENCE NUMERALS

1 Sports dumbbell
2 Grip portion
3 Support portion
4 First connecting portion
5 Second connecting portion
7 Passage hole
8 Strap
d1 Distance
d2 Distance D1 Diameter of grip portion
D2 Diameter of support portion
L1 Grip axis
L2 Support axis
S Centre of gravity

The invention claimed is:

1. A sports dumbbell comprising:

a grip portion (2) running along a grip axis (L1);

a support portion (3) including a support axis (L2), wherein the support axis (L2) is spaced from the grip portion (2) and runs parallel to the grip axis (L1);

wherein along the support axis (L2) the support portion (3) has mutually opposing first and second ends and at least one of the first and second ends of the support portion (3) is connected to the grip portion (2), wherein a distance (d2) between the grip axis (L1) and the support axis (L2) is at least 11 cm, wherein an outer shape of the sports dumbbell is fixed and substantially U-shaped, and wherein the sports dumbbell has a center of gravity (S) located inside the support portion (3) such that the sports dumbbell can be used in a manner that no torque is provoked in a user's wrist or arm; and an end of a length-adjustable strap (8) provided on each of a first and a second end of the grip portion, the length-adjustable strap configured to be held behind a heel of the user when a foot tip of the user is extended through a passage opening (7) formed between the grip portion (2) and the support portion (3) wherein the first and second ends of the grip portion (2) are mutually opposing along the grip axis (L1), the first end of the grip portion (2) is connected to the first end of the support portion (3) by a first connecting portion (4), and the second end of the grip portion (2) has no direct connection to the second end of the support portion (3).

2. The sports dumbbell according to claim 1, wherein the distance (d2) between the grip axis (L1) and the support axis (L2) is between 11 cm and 13 cm.

3. The sports dumbbell according to claim 1, wherein the support portion (3) has a maximum diameter (D2) between 8.5 cm and 12 cm, and a minimum diameter (D1) of the grip portion (2) is 3 cm.

4. The sports dumbbell according to claim 1, wherein a maximum diameter (D2) of the support portion (3) is at most three times as large as a minimum diameter (D1) of the grip portion (2).

5. The sports dumbbell according to claim 1, wherein the outer shape of the sports dumbbell (1) is formed by a plastic coating covering a complete surface of the sports dumbbell.

6. The sports dumbbell according to claim 1, wherein the grip portion (2) has a thumb notch.

* * * * *